United States Patent [19]

Saito

[11] 4,137,877

[45] Feb. 6, 1979

[54] ELECTRONIC CLOSED LOOP AIR-FUEL RATIO CONTROL SYSTEM

[76] Inventor: Masaaki Saito, Yokosuka, Japan

[21] Appl. No.: 780,792

[22] Filed: Mar. 23, 1977

[30] Foreign Application Priority Data

Mar. 24, 1976 [JP] Japan ..... 51/131447

[51] Int. Cl.[2] ..... F02B 33/00; F02B 3/00; F02M 7/00

[52] U.S. Cl. ..... 123/119 EC; 173/32 EE

[58] Field of Search ..... 123/32 EE, 119 EC; 60/285, 276, 119 E

[56] References Cited

U.S. PATENT DOCUMENTS

| | | | |
|---|---|---|---|
| 3,919,983 | 11/1975 | Wahl et al. | 123/32 EE |
| 3,952,710 | 4/1976 | Kawarada et al. | 123/32 EE |
| 4,006,718 | 2/1977 | Konomi | 123/32 EE |
| 4,027,637 | 6/1977 | Ano | 123/32 EE |
| 4,031,866 | 6/1977 | Asano | 123/32 EE |
| 4,040,394 | 8/1977 | Wahl et al. | 123/32 EE |
| 4,046,118 | 9/1977 | Aono | 123/32 EE |
| 4,052,968 | 10/1977 | Hattori et al. | 123/32 EE |
| 4,057,042 | 11/1977 | Aono | 123/32 EE |

*Primary Examiner*—Wendell E. Burns

[57] ABSTRACT

Disclosed is an electronic closed loop air-fuel ratio control system having a control means which generates a control signal which controls the air-fuel ratio and which is a function of both the air-fuel ratio and the direction of change of the ratio, such that If, for example, the signal from the exhaust gas sensor indicates that the air-fuel mixture is "rich" and the magnitude of the signal is within a predetermined regulated to become "rich" in order to quicken the response of the air-fuel ratio control system.

19 Claims, 10 Drawing Figures

CONTROL UNIT
CATALYTIC CONVERTER
ENGINE
10
8
2
4
6
30
16
14
20
18
24
22
26
27
33
34
32
36
40

V1
+α
Vs
-α
R
L

V2
I
O

V3
I
O

V4
I
O

V5
R
L

V6
R
L
T
T
T
T

R
L

ELECTRONIC CLOSED LOOP AIR-FUEL RATIO CONTROL SYSTEM

The present invention relates generally to an electronic closed loop air-fuel ratio control system for an internal combustion engine, and particularly to an improvement in such a system for speeding up the response thereof.

Various systems have been proposed to supply an optimal air-fuel mixture to an internal combustion engine in accordance with the mode of engine operation, one of which is to utilize the concept of an electric closed loop control system based on a sensed concentration of a component in exhaust gases of the engine.

According to the conventional system, an exhaust gas sensor, such as an oxygen analyzer, is deposited in the exhaust pipe for sensing a concentration of a component of exhaust gases from an internal combustion engine, generating an electrical signal representative of the sensed component. A differential signal generator is connected to the sensor for generating an electrical signal representative of a differential between the signal from the sensor and a reference signal. The reference signal is previously determined in due consideration of, for example, an optimum ratio of an airfuel mixture to the engine for maximizing the efficiency of both the engine and exhaust gas refining means. A control signal generator, which consists of a so-called proportional-integral (p-i) controller and an adder, is connected to the differential signal generator, receiving the signal therefrom to speed up a response of the system and also to make the operation of the system stable. A pulse generator is connected to the control signal generator, generating a train of pulses which is fed to an air-fuel ratio regulating means, such as electromagnetic valves, for supplying an air-fuel mixture with an optimum air-fuel ratio to the engine.

In the previously described control system, however, a problem is encountered that the response of the system is considerably slow with the result that it is practically difficult to precisely control the air-fuel ratio. Such a problem results from the fact that the regulated air-fuel mixture ratio is sensed by the exhaust gas sensor via the engine. The conventional control system usually uses, as the difference detecting circuit, a comparator which is directly connected to the proportional-integral controller and which senses whether the air-fuel ratio is "rich" or "lean", so that the response of the system can not be improved.

It is therefore a primary object of the present invention to provide an improved electronic closed loop air-fuel ratio control system the response of which is considerably improved.

A further and more specific object of the present invention is to provide an improved electronic closed loop air-fuel ratio control system which is designed based on the fact that, even if the air-fuel mixture ratio is "rich", when the magnitude of the signal from the exhaust gas sensor is within a predetermined range and at the same time the deviation of this signal directs toward "lean", then, it is supposed that the actual airfuel mixture ratio fed to the engine is already "lean".

These and other objects, features and many of the attendant advantages of the present invention will be appreciated more readily as the invention becomes better understood by the following detailed description, taken with the accompanying drawings, wherein like parts in each of the several figures are identified by the same reference characters, and wherein:

FIG. 1 schematically illustrates a conventional electronic closed loop air-fuel ratio control system for regulating the air-fuel ratio of the air-fuel mixture fed to an internal combustion engine;

Figure 3:
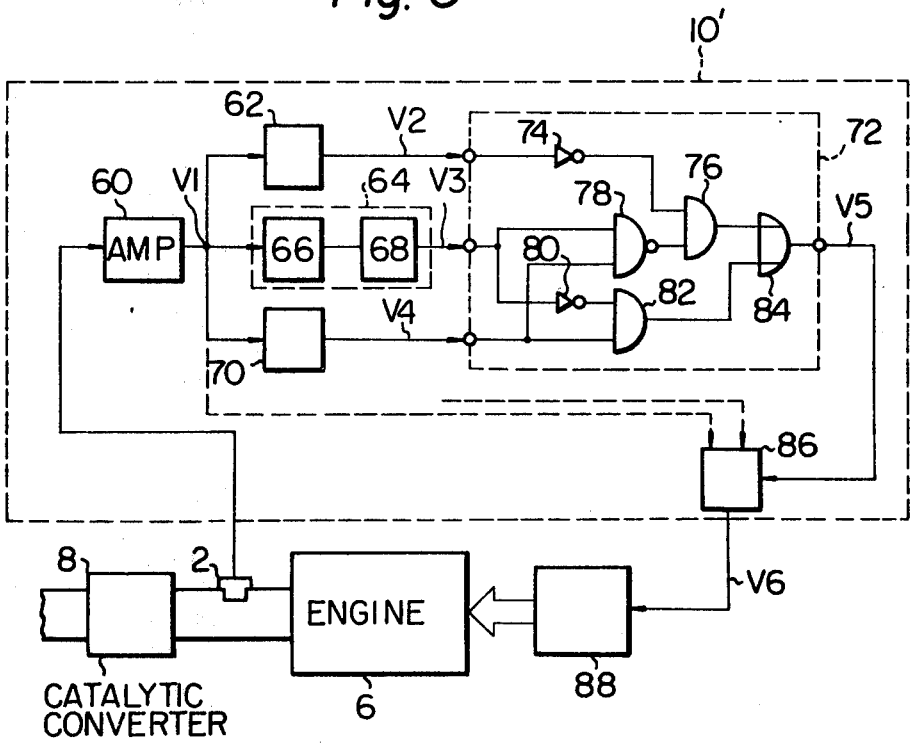
FIG. 3 is a preferred embodiment of the present invention.
Figures 4A, 4B, 4C, 4D, 4E, 4F, 4G:
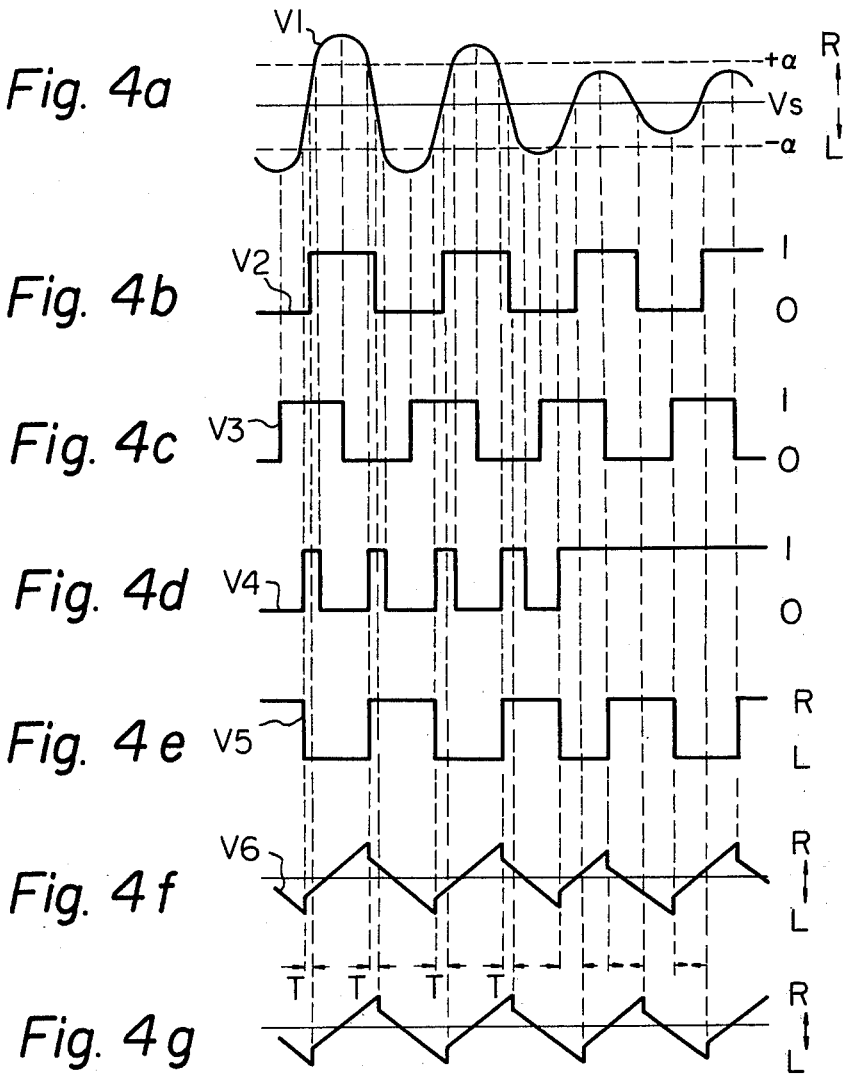

FIGS. 4*a*through 4*f* show waveforms of signals appearing at various parts of the circuit of FIG. 3; and FIG. 4*g* shows a waveform of a signal according to a conventional control system for better understanding of the present invention.

Figure 1:
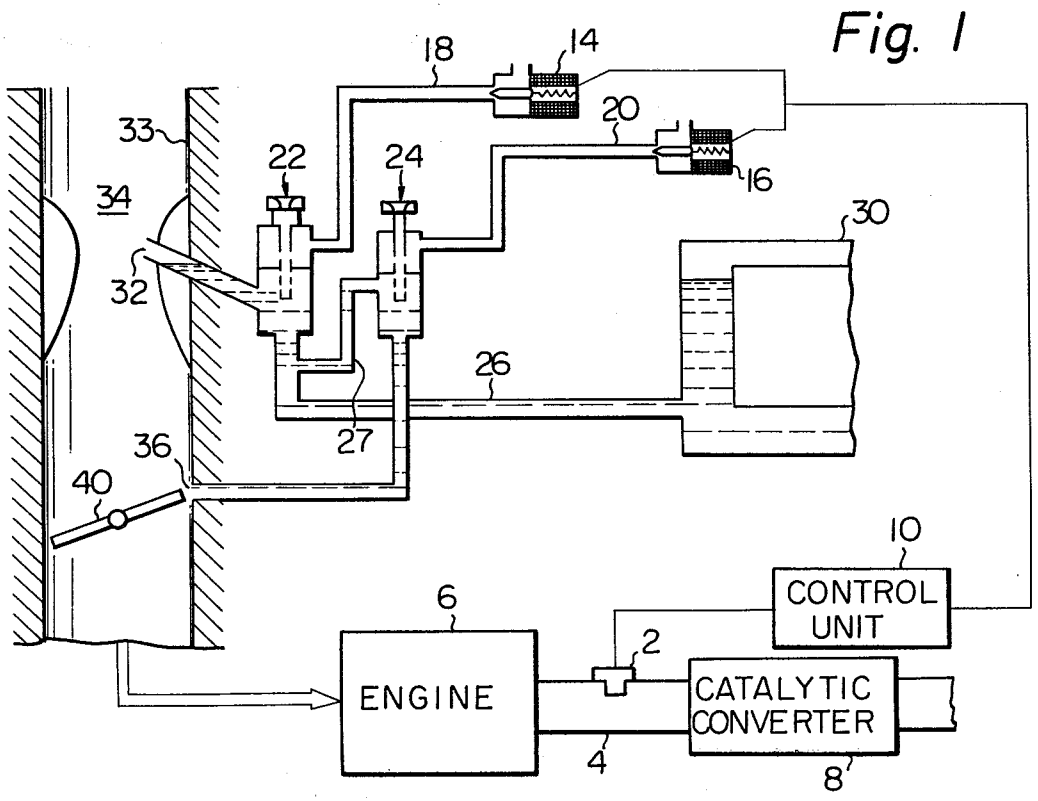

Reference is now made to drawings, first to FIG. 1, which schematically exemplifies in a block diagram a conventional electronic closed loop control system with which the present invention is concerned. The purpose of the system of FIG. 1 is to electrically control the air-fuel ratio of an air-fuel mixture supplied to an internal combustion eingine 6 through a carburetor (no numeral). An exhaust gas sensor 2, such as an oxygen, CO, HC, $NO_x$, or $CO_2$ analyzer, is disposed in an exhaust pipe 4 in order to sense the concentration of a component in exhaust gases. An electrical signal from the exhaust gas sensor 2 is fed to a control unit 10, in which the signal is compared with a reference signal to generate a signal representing a differential therebetween. The magnitude of the reference signal is previously determined in due consideration of an optimum air-fuel ratio of the air-fuel mixture supplied to the engine 6 for maximizing the efficiency of a catalytic converter 8. The control unit 10, then, generates a command signal, or in other words, a train of command pulses based on the signal representative of the optimum air-fuel ratio. The command signal is employed to operate two electromagnetic valves 14 and 16. The control unit 10 will be described in more detail in conjunction with FIG. 2.

The electromagnetic valve 14 is provided in an air passage 18, which terminates at one end thereof at an air bleed chamber 22, to control the rate of air flowing into the air bleed chamber 22 in response to the command pulses from the control unit 10. The air bleed chamber 22 is connected to a fuel passage 26 for mixing air with fuel delivered from a float bowl 30, supplying the air-fuel mixture to a venturi 34 through a discharging (or main) nozzle 32. Whilst, the other electromagnetic valve 16 is provided in another air passage 20, which terminates at one end thereof at another air bleed chamber 24, to control a rate of air flowing into the air bleed chamber 24 in response to the command pulses from the control unit 10. The air bleed chamber 24 is connected to the fuel passage 26 through a fuel branch passage 27 for mixing air with fuel from the float bowl 30, supplying the air-fuel mixture to an intake passage 33 through a low speed nozzle 36 adjacent to a throttle 40. As shown, the catalytic converter 8 is provided in the exhaust pipe 4 downstream of the exhaust gas sensor 2. In this case, for example, the electronic closed loop control system is designed to set the air-fuel ratio of the air-fuel mixture to about stoichiometry. This is because the three-way catalytic converter is able to simultaneously and most effectively reduce nitrogen oxides ($NO_x$), carbon monoxide (CO), and hydrocarbons (HC), only when the air-fuel mixture ratio is set at about stoichiometry. It is apparent, on the other hand, that, when other catalytic converter such as an oxidizing or deoxidizing type is employed, case by case setting of an air-fuel mixture ratio, which is different from the above, will be required for effective reduction of noxious components.

Figure 2:
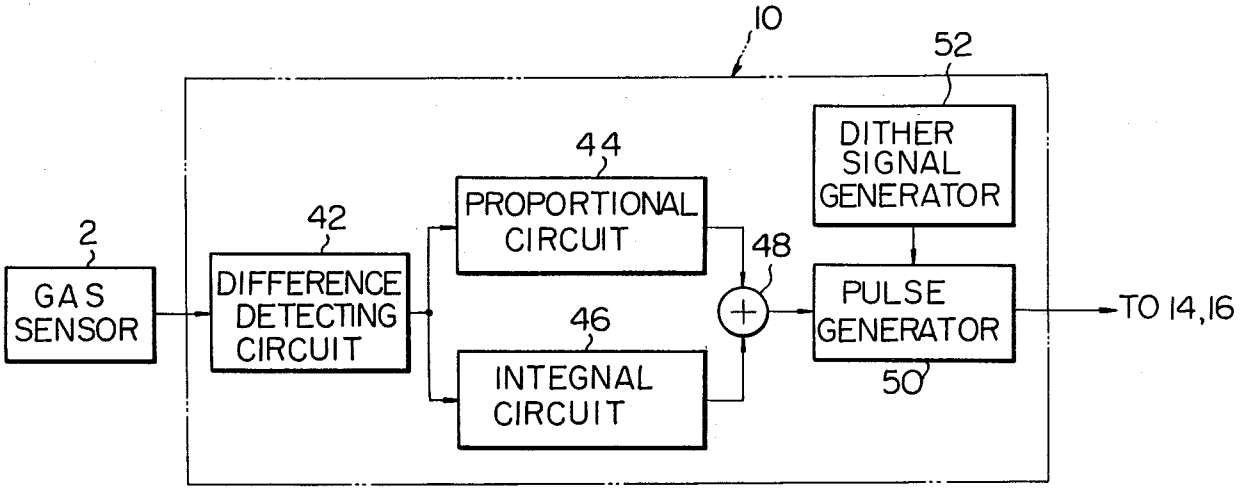
FIG. 2 is a detailed block diagram of an element of the system of FIG. 1.

Reference is now made to FIG. 2, in which somewhat detailed arrangement of the control unit 10 is schematically exemplified. The signal from the exhaust gas sensor 2 is fed to a difference detecting circuit 42 of the control 10, which circuit compares the incoming signal with a reference one to generate a signal representing a difference therebetween. The signal from the difference detecting circuit 42 is then fed to two circuits, viz., a proportional circuit 44 and an integration circuit 46. The purpose of the provision of the proportional and the integration circuits 44 and 46 is, as is well known to those skilled in the art, to increase both a response characteristic and stability of the system. The signals from the circuits 44 and 46 are then fed to an adder 48 in which the two signals are added. The signal from the adder 48 is then applied to a pulse generator 50 to which a dither signal is also fed from a dither signal generator 52. The command signal, which is in the form of pulses, is fed to the valves 14 and 16, thereby to control the "on" and "off" operation thereof.

In FIGS. 1 and 2, the electronic closed loop air-fuel ratio control system is illustrated together with a carburetor, however, it should be noted that the system is also applicable to a fuel injection device.

Reference is now made to FIGS. 3 and 4*a*–4*g*, wherein the former illustrates a first preferred embodiment of the present invention and the latters show waveforms of signals appearing at various parts of the circuit of FIG. 3 together with a waveform of a signal according to the conventional system. The output of the exhaust gas sensor 2 is fed to an amplifier 60 to be amplified therein by a predetermined amplification degree. The amplified signal, which is depicted by reference character V1, is then fed to three circuits 62, 64, and 70. The circuit 62, which is usually a comparator, compares the magnitude of the amplified signal with a predetermined level Vs (FIG. 4*a*) in order to sense whether the air-fuel mixture ratio is rich or lean, generating a signal V2 therefrom which takes a logic "1" and "0" when the air-fuel mixture ratio is rich and lean, respectively. The circuit 64, which consists of a differentiator 66 and a comparator 68, senses the direction of a deviation of the signal V1 from a level to which the air-fuel ratio should be regulated. The circuit 64 generates a signal V3 which takes a logic "1" and "0" when the direction is toward "rich" and "lean", respectively. The comparator 68 is of a type having hysteresis, more specifically, once the differentiator 66 produces a positive peak, the comparator 68 generates a signal representing one of two stable states until the differentiator 66 produces a negative peak and vice versa. On the other hand, the circuit 70, which is usually a comparator, senses whether the magnitude of the signal from the amplifier 60 is within a predetermined range defined by $\pm\alpha$ as shown in FIG. 4*a*. The circuit 70 generates a signal V4 which takes a logic "1" and "0" when the magnitude of the signal from the amplifier 60 is within or out of the range, respectively. The signal from the comparator 62 is then fed through an inverter 74 to an AND gate to which the output terminal of a NAND gate 78 is connected. The two input terminals of the NAND gate 78 are connected to the circuits 64 and 70, respectively. The circuit 64 is connected through another inverter 80 to an AND gate 82 to which the circuit 70 is also connected. The output terminals of the AND gates 76 and 82 are connected to an OR gate 84, the output terminal of which is connected to a control unit 86. The control unit 86 generates a control signal based on the signal from the OR gate 84. The signal from the control unit 86 is used to operate an actuator 88 corresponding to the electromagnetic valves 14 and 16 in FIG. 1. The signal V5 takes one of two logic values, that is, a logic "1" or "0" in accordance with the supplied signal V2, V3, and V4. The logic "1" and "0" of the signal V5 indicates that the air-fuel mixture ratio should be controlled to be rich and lean, respectively. The logical operation of the logical circuit 10' is readily understood by those skilled in the art, so that the discussion thereabout will be omitted for brevity. The truth table of the circuit 10' is as follows.

TRUTH TABLE OF CIRCUIT 10'

| SIGNAL V2 | SIGNAL V3 | SIGNAL V4 | SIGNAL V5 |
|---|---|---|---|
| 1 | 1 | 1 | 0 |
| 1 | 0 | 1 | 1 |
| 1 | 1 | 0 | 0 |
| 1 | 0 | 0 | 0 |
| 0 | 1 | 1 | 0 |
| 0 | 0 | 1 | 1 |
| 0 | 1 | 0 | 1 |
| 0 | 0 | 0 | 1 |

When the control unit 88 is a proportional-integral controller, the waveform of the signal from the control unit 10' is as shown in FIG. 4*f*, and on the other hand, the waveform of the signal from the control unit 10 of FIG. 1 is as shown in FIG. 4*g*. When comparing the two waveforms of FIGS. 4*f* and 4*g*, it is understood that the signal shown in FIG. 4*f* is in advance by "T" every one cycle relative to the signal as shown in 4*g*.

In the above, the system embodying the present invention can be modified for a further improvement of the response of the system such that the gain of the control unit 88 can be controlled by the amplifier 60 and/or the circuit 64 as shown by broken lines in FIG. 3.

It is appreciated from the foregoing that, in accordance with the present invention, the response of the system can be considerably speeded up in comparison with that of the conventional system. This improvement is based on the fact that, even if the air-fuel mixture ratio is rich, when the magnitude of the signal from the exhaust gas sensor is within the predetermined range and at the same time the direction of this signal directs toward "lean", then, it is determined that the actual air-fuel mixture ratio fed to the engine is already "lean".

What is claimed is:

1. An electronic closed loop air-fuel ratio control system for supplying an optimum air-fuel mixture to an internal combustion engine, which system comprises in combination:

an air-fuel mixture supply assembly;

an exhaust pipe having exhaust gas flowing therethrough;

an exhaust gas sensor provided in said exhaust pipe which senses the concentration of a component of said exhaust gas, and generates a first signal corresponding to the magnitude thereof;

a control means connected to the exhaust gas sensor which receives and analyzes the signal of said sensor, and which generates therefrom a control signal which has a value which is in a reverse relationship with the value of said first signal at least when said first signal is within a predetermined range of a reference signal and the direction of change in magnitude of said first signal is away from said reference signal, in order to accelerate the response of said control system; and, an actuator provided in the air-fuel mixture supply assembly and connected to the control means, which receives said control signal and is responsive thereto for adjusting the air-fuel mixture fed to the engine.

2. The electronic closed loop air-fuel ratio control system of claim 1, further comprising an amplifier connected between said sensor and said control means.

3. The electronic closed loop air-fuel ratio control system recited in claim 1, wherein the control means comprises:

a first means for comparing the magnitude of said first signal with said reference signal in order to sense whether the air-fuel ratio is rich or lean, which generates a first logic signal indicative of the sensed condition, said first means being connected to the exhaust gas sensor;

a second means for sensing the direction of change in magnitude of the first signal from the reference signal, which generates a second logic signal indicative of the sensed condition, said second means being connected to the exhaust gas sensor;

a third means for sensing whether the magnitude of said first signal is within or out of the predetermined range, which generates a third logic signal indicative of the sensed condition, said third means being connected to said exhaust gas sensor; and, a logic circuit connected to said first, second, and third means, which receives logic signals therefrom, and which performs a logic operation thereon and converts said signals into said control signal.

4. The electronic closed loop air-fuel ratio control system recited in claim 3, wherein the value of the control signal is in a reverse relationship with the value of said first signal when the magnitude of said first signal is outside of the predetermined range and simultaneously the change in magnitude of said first signal is away from the reference signal.

5. The electronic closed loop air-fuel ratio control system recited in claim 3, wherein the value of the control signal corresponds with the value of said first signal when the magnitude of said first signal is outside of the predetermined range and the change in magnitude of the first signal is toward the reference signal.

6. The electronic closed loop air-fuel ratio control system recited in claim 3, further comprising a proportional-integral controller provided between the control means and the actuator.

7. The electronic closed loop air-fuel ratio control system recited in claim 3, wherein:

said first means comprises a comparator, and the logic signal generated thereby has a logic value of "1" and "0" when the air-fuel ratio is rich and lean, respectively;

said second means comprises a differentiator connected to the exhaust gas sensor and a comparator connected between the differentiator and the logic circuit, and the logic signal generated thereby has a logic value of "1" and "0" when the change in magnitude of the first signal from the reference signal is toward rich and lean, respectively;

said third means comprises a comparator, and the third logic signal therefrom comprises a logic value of "1" and "0" when the magnitude of said first signal is within and out of the predetermined range, respectively; and, said control signal comprises a logic value of "1" for making the air-fuel ratio rich when each of the first, second, and third logic signals has a logic value of "0", and a logic value of "0" for making the air-fuel ratio lean when each of the first and second logic signals has a logic value of "1" and simultaneously the third logic signal has a logic value of "0".

8. The electronic closed loop air-fuel ratio control system recited in claim 3, wherein:

said first means comprises a comparator, and the first logic signal generated thereby comprises a logic value of "1" and "0" when the air-fuel ratio is rich and lean, respectively;

said second means comprises a differentiator connected to the exhaust gas sensor and a comparator connected between the differentiator and the logic circuit, and the second logic signal emitted therefrom comprises a logic value of "1" and "0" when the change in magnitude of said first signal from the reference signal is toward rich and lean, respectively;

said third means comprising a comparator, and the third logic signal therefrom comprises a logic value of "1" when the magnitude of said first signal is within and out of the predetermined range, respectively; and, said control signal comprises a logic value of "1" for making the air-fuel ratio rich when each of the first, second, and third logic signals comprises a logic value of "0", a logic value of "0" for making the air-fuel ratio lean when each of the first and second logic signals comprises a logic value of "1" and simultaneously the third logic signal has a logic value of "0", a logic value of "1" for making the air-fuel ratio rich when each of the first and third logic signals has a logic value of "0" and simultaneously the second logic signal comprises a logic value of "1", and a logic value of "0" for making the air-fuel ratio lean when each of the second and third logic signals has a logic value of "0" and simultaneously the first logic signal has a logic value of "1".

9. The electronic closed loop air-fuel ratio control system of claim 7, wherein the logic circuit comprises:

a first inverter connected to said first means;

a first AND gate connected at one of its two input terminals to said first inverter;

a NAND gate connected at one of its two input terminals to said third means and at the other input terminal to said second means, and at its output terminal to the other input terminal of said first AND gate;

a second inverter connected to said second means;

a second AND gate connected at one of its two input terminals to said second means over the second inverter and at the other input terminal to said third means; and an OR gate connected at its two input terminals to the output terminals of the first and second AND gates, respectively, and at its output terminal to the actuator.

10. The electronic closed loop air-fuel ratio control system of claim 8, wherein the logic circuit comprises:

a first inverter connected to said first means;

a first AND gate connected at one of its two input terminals to said first inverter;

a NAND gate connected at one of its two input terminals to said third means and at the other input terminal to said second means, and at its output terminal to the other input terminal of said first AND gate;

a second inverter connected to said second means;

a second AND gate connected at one of its two input terminals to said second means over the second inverter and at the other input terminal to said third means; and, an OR gate connected at its two input terminals to the output terminals of the first and second AND gates, respectively, and at its output terminal to the actuator.

11. An electronic closed loop air-fuel ratio control system for supplying an optimum air-fuel mixture to an internal combustion engine, which system comprises in combination:

an air-fuel mixture supply assembly;

an exhaust pipe having exhaust gas flowing therethrough;

an exhaust gas sensor provided in said exhaust pipe which senses the concentration of a component of said exhaust gas, and generates a first signal corresponding to the magnitude thereof;

a first means for comparing the magnitude of said first signal with a reference signal corresponding to an optimum air-fuel ratio in order to sense whether the air-fuel ratio is rich or lean, which generates a first logic signal indicative of the sensed condition, said first means being connected to the exhaust gas sensor;

a second means for sensing the direction of change in magnitude of said first signal from the reference signal, which generates a second logic signal indicative of the sensed condition, said second means being connected to the exhaust gas sensor;

a third means for sensing whether the magnitude of the first signal is within or out of a predetermined range of the reference signal, which generates a third logic signal indicative of the sensed condition, said third means being connected to the exhaust gas sensor; and, a logic circuit connected to said first, second, and third means, which receives the logic signals therefrom, and which performs a logic operation thereon and converts said signals into a control signal, said control signal having a value which is in a reverse relationship with the value of said first signal at least when said first signal is within the predetermined range of said reference signal and the change in magnitude of said first signal is away from said reference signal in order to accelerate the response of said control system; and, an actuator provided in the air-fuel mixture supply assembly and connected to the logic circuit, which receives said control signal and is responsive thereto for adjusting the air-fuel mixture fed to the engine.

12. The electronic closed loop air-fuel ratio control system of claim 11, further comprising an amplifier connected between said sensor and said first, second, and third means.

13. The electronic closed loop air-fuel ratio control system recited in claim 11, wherein the value of the control signal is in a reverse relationship with the value of said first signal when the magnitude of said first signal is outside of the predetermined range and simultaneously the change in magnitude of said first signal is away from the reference signal.

14. The electronic closed loop air-fuel ratio control system of claim 11, wherein the value of the control signal corresponds with the value of said first signal when the magnitude of said first signal is outside of the predetermined range and the change in magnitude of said first signal is toward the reference signal.

15. The electronic closed loop air-fuel ratio control system as claimed in claim 11, further comprising a proportional-integral controller provided between the logic circuit and the actuator.

16. The electronic closed loop air-fuel ratio control system of claim 11, wherein:

said first means comprises a comparator, and the logic signal generated thereby has a logic value of "1" and "0" when the air-fuel ratio is rich and lean, respectively;

said second means comprises a differentiator connected to the exhaust gas sensor and a comparator connected between the differentiator and the logic circuit, and the logic signal generated thereby has a logic value of "1" and "0" when the change in magnitude of the first signal from the reference signal is toward rich and lean, respectively;

said third means comprises a comparator, and the third logic signal therefrom comprises a logic value of "1" and "0" when the magnitude of said first signal is within and out of the predetermined range, respectively; and, said control signal comprises a logic value of "1" for making the air-fuel ratio rich when each of the first, second, and third logic signals has a logic value of "1", and a logic value of "0" for making the air-fuel ratio lean when each of the first and second logic signals has a logic value of "1" and simultaneously the third logic signals has a logic value of "0".

17. The electronic closed loop air-fuel ratio control system of claim 11, wherein:

said first means comprises a comparator, and the first logic signal generated thereby comprises a logic value of "1" and "0" when the air-fuel ratio is rich and lean, respectively;

said second means comprises a differentiator connected to the exhaust gas sensor and a comparator connected between the differentiator and the logic circuit, and the second logic signal emitted therefrom comprises a logic value of "1" and "0" when the change in magnitude of said first signal from the reference signal is toward rich and lean, respectively;

said third means comprising a comparator, and the third logic signal therefrom comprises a logic value of "1" and "0" when the magnitude of said first signal is within and out of the predetermined range, respectively; and, said control signal comprises a logic value of "1" for making the air-fuel ratio rich when each of the first, second, and third logic signals comprises a logic value of "0", a logic value of "0" for making the air-fuel ratio lean when each of the first and second logic signals comprises a logic value of "1" and simultaneously the third logic signal has a logic value of "0", a logic value of "1" for making the air-fuel ratio rich when each of the first and third logic signals has a logic value of "0" and simultaneously the second logic signal comprises a logic value of "1", and a logic value of "0" for making the air-fuel ratio lean when each of the second and third logic signals has a logic value of "0" and simultaneously the first logic signal has a logic value of "1".

18. The electronic closed loop air-fuel ratio control system recited in claim 16, wherein the logic circuit comprises:

a first inverter connected to said first means;

a first AND gate connected at one of its two input terminals to said first inverter;

a NAND gate connected at one of its two input terminals to said third means and at the other input terminal to said second means, and at its output terminal to the other input terminal of said first AND gate;

a second inverter connected to said second means;

a second AND gate connected at one of its two input terminals to said second means over the second inverter and at the other input terminal to said third means; and, an OR gate connected at its two input terminals to the output terminals of the first and second AND gates, respectively, and at its output termanal to the actuator.

19. The electronic closed loop air-fuel ratio control system recited in claim 17, wherein the logic circuit comprises:

a first inverter connected to said first means;

a first AND gate connected at one of its two input terminals to said first inverter;

a NAND gate connected at one of its two input terminals to said third means and at the other input terminal to said second means, and at its output terminal to the other input terminal of said first AND gate;

a second inverter connected to said second means;

a second AND gate connected at one of its two input terminals to said second means over the second inverter and at the other input terminal to said third means; and, an OR gate connected at its two input terminals to the output terminals of the first and second AND gates, respectively, and at its output terminal to the actuator.

* * * * *